US005920252A

United States Patent [19]

Nakagawa

[11] Patent Number: 5,920,252

[45] Date of Patent: Jul. 6, 1999

[54] HIGH-VOLTAGE VARIABLE RESISTOR

[75] Inventor: Kazuhiro Nakagawa, Fukui-ken, Japan

[73] Assignee: Murata Manufacturing Co., Ltd., Nagaokakyo, Japan

[21] Appl. No.: 08/882,295

[22] Filed: Jun. 25, 1997

[30] Foreign Application Priority Data

Jun. 27, 1996 [JP] Japan ..... 8-167530

[51] Int. Cl.[6] ..... H01C 10/30

[52] U.S. Cl. ..... 338/160; 338/162; 338/70; 338/202

[58] Field of Search ..... 338/160, 162, 338/70, 219, 174, 202, 324, 190; 361/752; 439/66, 441, 439, 862, 929

[56] References Cited

U.S. PATENT DOCUMENTS

| | | | |
|---|---|---|---|
| 3,697,926 | 10/1972 | Krafthefer et al. | 339/17 L |
| 3,853,382 | 12/1974 | Lazar et al. | 339/95 R |
| 5,508,678 | 4/1996 | Tsunezawa et al. | 338/160 |
| 5,546,280 | 8/1996 | Hasebe et al. | 361/752 |

*Primary Examiner*—Teresa Walberg
*Assistant Examiner*—Jeffrey Pwu
*Attorney, Agent, or Firm*—Burns, Doane, Swecker & Mathis, L.L.P.

[57] ABSTRACT

A high-voltage variable resistor includes a structure which makes it possible to achieve stable and reliable contact conduction between a connection terminal 7 and a terminal electrode 2*a*. The connection terminal 7 includes a spring portion 7*b*. At the end of the spring terminal 7*b* there is provided a flat contact section 7*d* which is wider than the other portions thereof. A plurality of protrusions 7*e*, 7*f* are formed on this contact section 7*d*. The outer edge portion of a lead line connecting section 7*a* of the connection terminal 7, which is accommodated in and fixed to a connection terminal accommodating section 6, is held in a terminal holding groove 6*a* of the connection terminal holding section 6, and the protrusions 7*e*, 7*f* are held in contact with the terminal electrode 2*a* of an insulating substrate 2 and pressed against the insulating substrate 2. A core wire 8*a* of a lead line 8, which is inserted into a lead line holding cylinder 1*b*, is held by holding members 7*c* of the connection terminal 7 and connected to the connection terminal 7 thereby.

21 Claims, 2 Drawing Sheets

HIGH-VOLTAGE VARIABLE RESISTOR

BACKGROUND OF THE INVENTION

This application corresponds to Japanese Patent Application No. 8-167530 filed on Jun. 27, 1996, which is hereby incorporated by reference in its entirety.

1. Field of the Invention

The present invention relates to a high-voltage variable resistor used to adjust the focus voltage, screen voltage, etc. of a television receiver or like device.

2. Description of the Related Art

FIGS. 4 through 6 show the structure of an example of a conventional high-voltage variable resistor of the above-mentioned type. In this device, the connection between an electrode formed on a substrate and lead lines is possible without performing soldering. FIG. 4 is a sectional side view of a high-voltage variable resistor. FIG. 5 is an exploded perspective view showing a connection terminal holding structure. FIG. 6 is a sectional view showing the main components of a connection structure using a connection terminal.

As shown in FIG. 4, in this high-voltage variable resistor, an insulating substrate 2 formed of a ceramic material, such as alumina, is glued and fixed to a step section formed in the inner periphery of an insulating case 1 having one side open and formed of a synthetic resin. Rotation shafts 5 to which sliding members 4 are mounted are rotationally supported by cylindrical bearings 1*a* provided on the front side of the insulating case 1. An epoxy-type resin coating 3 is formed by molding on the open side of the. insulating case 1 and on the back side of the insulating substrate 2 (which is shown on the upper side in the drawing).

A lead line holding cylinder 1*b* is provided on the insulating case 1, and a connection terminal accommodating section 6 is provided inside the insulating case 1 and at the base of the lead line holding cylinder 1*b*. The connection terminal accommodating section 6 accommodates a connection terminal 7, which is in contact with and electrically connected to a terminal electrode formed on the surface of the insulating substrate 2. An output lead line 8 for extracting a focus voltage and a screen voltage is inserted into the lead line holding cylinder 1*b*, and the lead line 8 inserted into this cylinder is connected to the connection terminal 7.

As shown in the enlarged views of FIGS. 5 and 6, the connection terminal 7 is formed by punching (e.g. stamping) the part out from a flat metal plate. The connection terminal 7 has a substantially rectangular lead line connecting section 7*a* at the center of which a plurality of holding members 7*c* are formed. The connection terminal 7 also includes a spring portion 7*b* bent into a curved configuration.

The spring portion 7*b*, which protrudes from the center of one side of the lead wire connecting section 7*a* toward the insulating substrate 2, is formed having a predetermined width which is smaller than the width of the lead line connecting section 7*a* in order to obtain the requisite elasticity.

The lead line connecting section 7*a* of the connection terminal 7 is held in a terminal holding groove 6*a* of the connection terminal accommodating section 6, and a part of the spring portion 7*b* is held in contact with an output terminal electrode 2*a* of the insulating substrate 2 and pressed against the insulating substrate 2. In this state, the connection terminal 7 is accommodated in the connection terminal accommodating section 6 and secured in position therein. A core wire 8*a* of the lead wire 8 inserted into the lead wire holding cylinder 1*b* is held by the holding members 7*c* to thereby provide electrical connection with the connection terminal 7.

Although not shown, on the surface of the insulating substrate 2 (i.e., the lower surface thereof as seen in FIG. 4), there is formed an input terminal electrode to which high voltage is input, a grounding terminal electrode, an output terminal electrode for focus voltage and screen voltage, etc., and a resistor (e.g. film resistor) having a predetermined pattern. For example, the film resistor may comprise an arcuate variable resistor portion formed between the input terminal electrode and the grounding terminal electrode. One end of each sliding member 4 is arranged so as to slide on the variable resistor portion of the film resistor. Further, although not shown, lead terminals or lead wires for grounding and inputting high voltage are connected to the terminal electrodes by soldering, by contact with a conductive rubber member, or the like, and are led out from the open side of the insulating case 1.

However, in the above-described conventional high-voltage variable resistor, the connection terminal 7 and the terminal electrode 2*a* of the insulating substrate 2 are held in contact only at the limited surface region where the spring portion 7*b* contacts the terminal electrode 2*a*. Typically, this contacting surface region between the spring portion 7*b* and the terminal electrode 2*a* is quite small, and may form a limited contact line or point. When there exists insulating foreign matter such as adhesive material in the contact region between the connection terminal 7 and the terminal electrode 2*a*, the contact state becomes unstable, resulting in defective conduction, etc.

SUMMARY OF THE INVENTION

It is accordingly an object of the present invention to provide a high-voltage variable resistor which makes it possible to achieve stable and reliable contact conduction between the connection terminal and the terminal electrode.

To achieve the above object, there is provided, in accordance with a first aspect of the invention, a high-voltage variable resistor comprising: (a) an insulating case having at least one open side, which includes a connection terminal accommodating section; (b) an insulating substrate provided in the insulating case, the substrate having a surface, wherein a resistor and an electrode are formed on the surface; (c) a rotation shaft which is rotationally supported by the insulating case, wherein the rotation shaft is equipped with a sliding member; and (d) a connection terminal which is provided in the connection terminal accommodating section and which detachably connects the electrode to an input/output lead line. The connection terminal includes a spring portion bent into a curved form, and the spring portion includes a contact section which has at least one protrusion held in press contact with the electrode.

In accordance with another aspect of the invention, there is provided a high-voltage variable resistor comprising: (a) an insulating case having at least one open side, which includes a connection terminal accommodating section; (b) an insulating substrate provided in the insulating case, the substrate having a surface, wherein a resistor and an electrode are formed on the surface; (c) a rotation shaft which is rotationally supported by the insulating case, wherein the rotation shaft is equipped with a sliding member; and (d) a connection terminal which is provided in the connection terminal accommodating section and which detachably connects the electrode to an input/output lead line. The connection terminal has a spring portion bent into a curved form, the spring portion having at its forward end a contact section which is wider than other portions of the spring portion, wherein the contact section is arranged in parallel with a plane of the electrode, further wherein the contact section includes a plurality of protrusions held in press contact with the electrode.

In accordance with a third aspect of the invention, an electrical component is provided comprising: (a) a casing having a connection terminal accommodating section disposed therein and an opening for feeding a lead line to the connection terminal accommodating section; (b) an electrode formed on a substrate, at least a portion of which can be accessed from the connection terminal accommodating section; and (c) a connection terminal disposed within the connection terminal accommodating section for connecting the lead line with the electrode. The connection terminal, in turn, includes: (c1) a lead line connection section for forming an electrical contact with the lead line; (c2) a spring portion extending from the lead line connection section, the spring portion terminating in a contact section; and (c3) one or more protrusions extending from the contact section for resiliently contacting the electrode.

A fourth aspect of the invention pertains to the above-identified connection terminal itself. A fifth aspect of the invention pertains to a method of making the connection terminal comprising steps of: (a) providing a flat metal sheet; (b) stamping out the connection terminal from the flat metal sheet, the connection terminal comprising a lead line connection section and a spring portion which terminates in a contact section; (c) punching out one or more protrusions from the contact section; and (d) bending the spring portion into a curved shape.

In accordance with the invention as described above, at least one protrusion is provided on the contact section of the spring portion of the connection terminal. This structure reduces the possibility of foreign matter adhering to the contact surface. Further, even if foreign matter adheres to the protrusion, the protrusion is brought into contact with the electrode of the insulating substrate such that the protrusion slightly digs into (e.g. penetrates) the electrode, so that a defective contact due to the adhesion of foreign matter is mitigated, thereby making it possible to achieve stable and reliable contact conduction between the connection terminal and the electrode. That is, by providing the contact section of the connection terminal with one or more protrusions, the surface area of the spring portion which contacts the electrode is reduced to thereby increase the contact pressure, whereby foreign matter is prevented from existing in the contact section.

In accordance with the invention, the contact section situated at the forward end of the spring portion of the connection terminal is formed having a larger width than other parts of the spring portion, and a plurality of protrusions are provided on this contact section. Thus, line contact (where the contact spans the length of a line) or point contact is effected at a plurality of positions over a wider range, so that a defective contact due to the adhesion of foreign matter is substantially mitigated, thereby making it possible to achieve stable and reliable contact conduction. That is, in the connection terminal of the present invention, the contact section is formed having a large width so that the contact range is increased, and, by providing a plurality of protrusions, a multi-point contact is provided. Further, the area of each region where the connection terminal contacts the electrode is reduced to thereby increase the contact pressure.

BRIEF DESCRIPTION OF THE DRAWINGS

The foregoing, and other, objects, features and advantages of the present invention will be more readily understood upon reading the following detailed description in conjunction with the drawings in which.

DESCRIPTION OF THE PREFERRED EMBODIMENT

Figure 1:
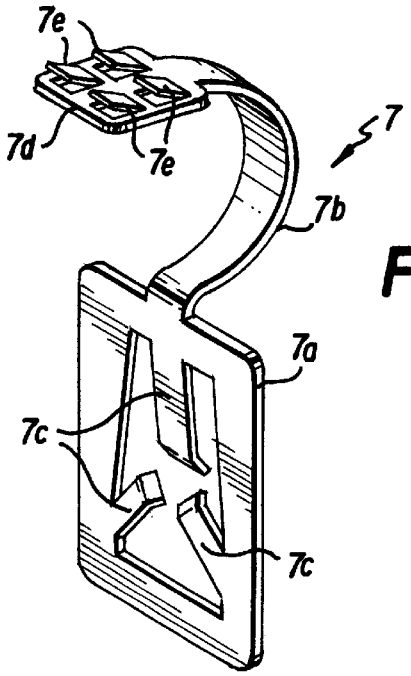
FIG. 1 is a perspective view of an exemplary connection terminal according to a first embodiment of the present invention.

Embodiments of the present invention will now be described with reference to the drawings. In the drawings, the components which are the same as those of the above-described conventional example and the components having the same functions as those of the conventional example are indicated by the same reference numerals.

Figure 2:
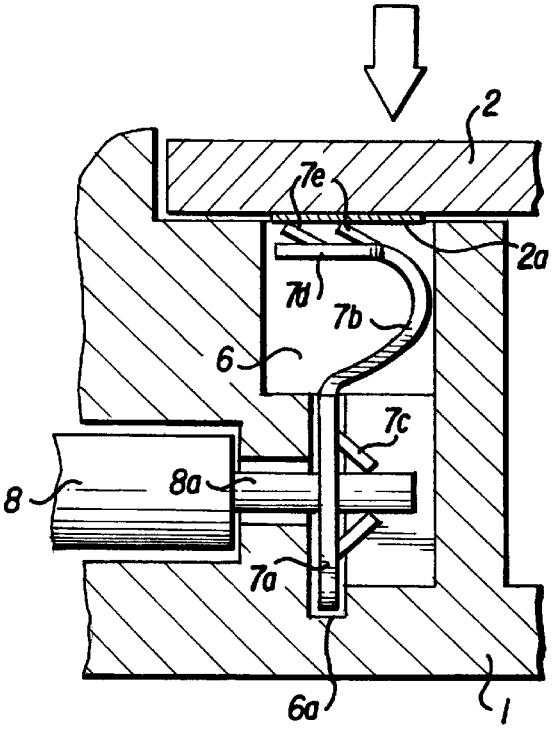
FIG. 2 is sectional view showing main components of a connection structure of a high-voltage variable resistor employing the connection terminal of the first embodiment of the present invention.

FIGS. 1 and 2 show a connection terminal of a high-voltage variable resistor according to the first exemplary embodiment of the present invention and a connection structure using the connection terminal, respectively.

As shown in FIGS. 1 and 2, in the high-voltage variable resistor of this embodiment, the spring portion 7*b* of the connection terminal 7 has at its forward end a contact section 7*d* which is wider than the other parts of the spring portion 7*b*. Protrusions consisting of four protruding members 7*e* are formed on this contact section 7*d*. According to exemplary embodiments, the contact section 7*d* is formed as a substantially rectangular planar section, and is integrally connected to the spring portion 7*b*. When employed in a connection structure, the contact section 7*d* is disposed in parallel with the surface of the insulating substrate 2. The protrusions 7*e* can be formed by punching (e.g. stamping) the protrusions out of the contact section 7*d* into a predetermined configuration, and then bending the protrusions so that they protrude outward from the face of the contract section 7*d* toward the lower face of the insulating substrate 2. For instance, in the specific embodiment shown in FIG. 1, the protrusions are substantially rectangular-shaped. The protrusions are formed by punching out ⊓-shaped patterns in the contact section 7*d* and then bending the metal enclosed by the ⊓-shaped patterns outward. Alternatively, the punching and bending can be performed in one operation.

The connection terminal 7 is accommodated in and fixed to the connection terminal accommodating section 6. When the connection terminal 7 is disposed in the accommodating section 6, the outer edge portion of the lead line connecting section 7*a* is held in the connection terminal holding groove 6*a* of the connection terminal accommodating section 6. In this state, the protrusions 7*e* are held in contact with the output connection terminal 2*a* of the insulating substrate 2, which presses against the protrusions 7*e*. In one embodiment, the contact pressure can be set so that protrusions 7*e* slightly dig into (e.g. penetrate) the electrode 2*a*.

The core wire 8*a* of the lead line 8, inserted into the lead wire holding cylinder 1*b*, is held by the holding members 7*c* and is thereby connected to the connection terminal 7.

Apart from the construction of the above-described connection terminal 7, the construction of this embodiment is the same as that of the conventional example, and a further description thereof will be omitted.

In the construction of this embodiment, the contact section 7*d* is formed so as to be flat and wide so that the range of contact surface facing the output terminal electrode 2*a* is enlarged. Further, electrical contact with the output terminal electrode 2*a* is effected with a plurality of protrusions 7*e*, so that defective contact due to adhesion of foreign matter is substantially decreased. That is, the point of contact extends over a wide range and contact is effected at a plurality of positions, so that, even when foreign matter adheres to a part of the protrusions, a stable contact can be achieved at other contact positions. Further, the contact area at which each protrusion 7*e* contacts the terminal electrode 2*a* is small so that foreign matter is not easily allowed to adhere to each protrusion 7*e*. Even when foreign matter adheres, it is easily detached from the contact section. Further, the contact pressure at each contact section is high, so that the possibility of defective contact due to adhesion of foreign matter is substantially reduced, thereby making it possible to achieve a stable and reliable contact conduction.

In the above-described exemplary embodiment, the width of the contact section 7*d* of the connection terminal 7 is larger than the width of the other parts of the spring portion 7*b*. However, other configurations are possible. For instance, the width of the contact section 7*d* may have the same width as the spring portion 7*b*. Furthermore, the contact section 7*d* can be formed in shapes other than as depicted in FIG. 1.

The configuration (e.g. shape), number, and positioning of the protrusions 7*e* can be varied from the embodiment shown in FIG. 1. At least one protrusion on the contact section 7*d* will suffice. For example, by varying the configuration of the contact section 7*d* held in contact with the electrode 2*a*, it is possible to vary the contact area at each protrusion 7*e*. Further, it is also possible to vary the spring pressure of the protrusions 7*e* by varying the width, length, etc. of the protrusions 7*e*, making it possible to achieve optimum contact conduction in accordance with the configuration and material of the electrode.

Figure 3:
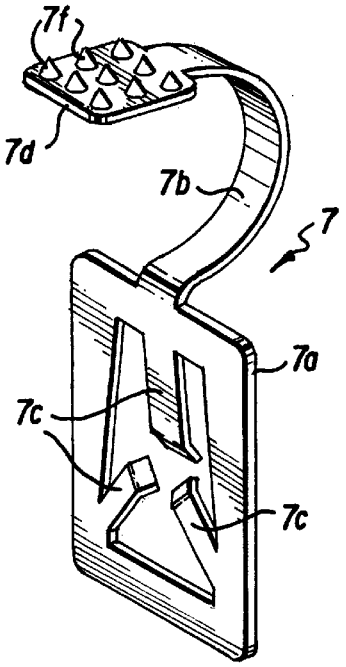
FIG. 3 is a perspective view of an exemplary connection terminal according to a second embodiment of the present invention.
Figure 4:
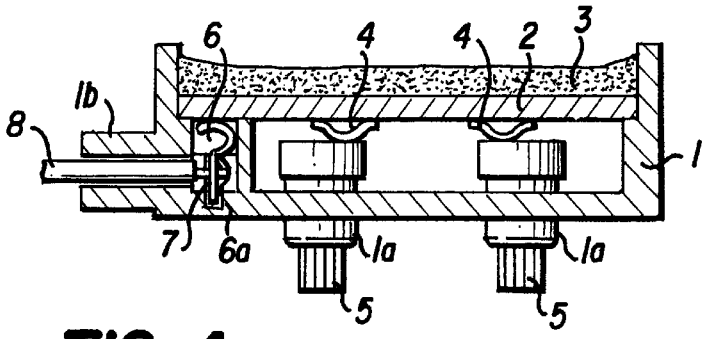
FIG. 4 (PRIOR ART)
FIG. 4 is a sectional side view of a conventional high-voltage variable resistor.
Figure 5:
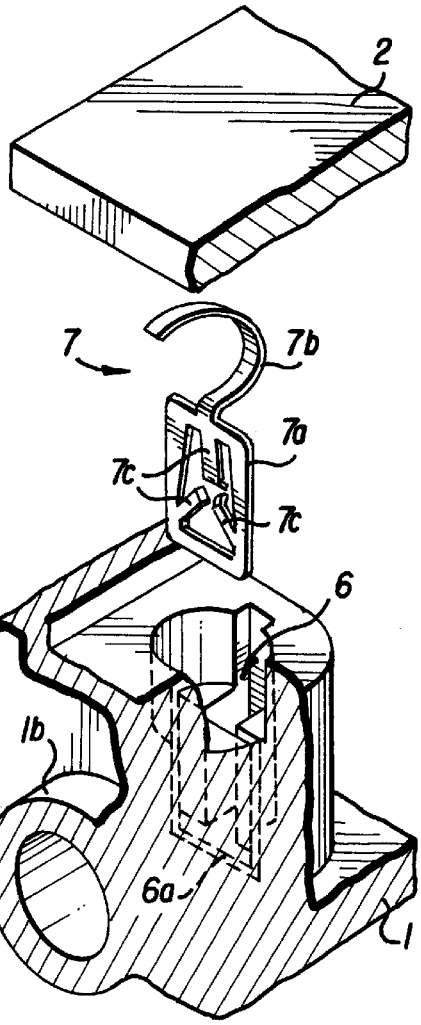
FIG. 5 (PRIOR ART)
FIG. 5 is an exploded perspective view showing a conventional connection terminal holding structure.
Figure 6:
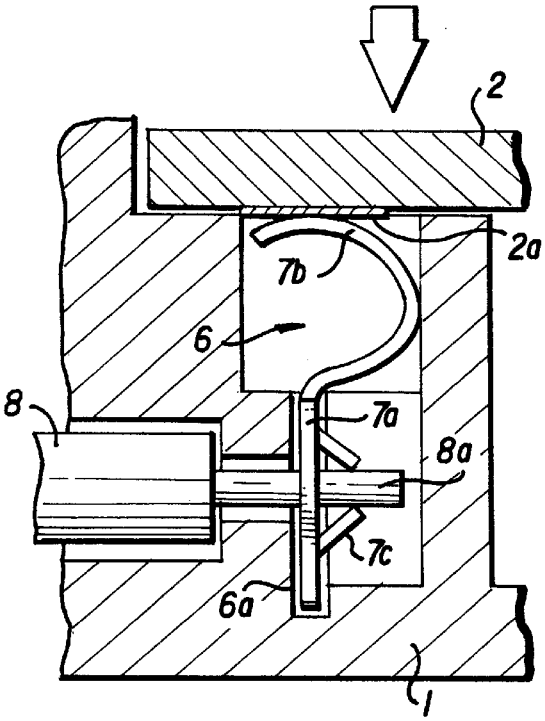
FIG. 6 (PRIOR ART)
FIG. 6 is a sectional view showing the main components of a connection structure for use with a conventional connection terminal.

Next, FIG. 3 shows the construction of a connection terminal 7 according to the second exemplary embodiment of the present invention. As shown in FIG. 3, in the connection terminal of this embodiment, a large number of cone-shaped protrusions 7*f* are formed on the contact section 7*d* provided at the forward end of the spring portion 7*b*. Each protrusion 7*f* is formed by press molding using a punch (e.g. a die) with a pointed forward end or by like technique. When the connection terminal 7 is mounted in a connection structure, the protrusions 7*f* protrude toward the insulating substrate. The protrusions 7*f* can also form separate conductive elements which are affixed (e.g. metallurgically bonded) to the contact section 7*d*.

Apart from the construction of the above-described protrusions, the construction of the second embodiment is the same as that of the first embodiment, and further description thereof will be omitted. As with the first embodiment, in the connection terminal of the second embodiment, the protrusions 7*f* are held in point contact with the electrode 2*a* at a plurality of positions over a wide range, and the contact area at each point of contact with the electrode 2*a* is small, so that it is possible to achieve a stable and reliable contact conduction.

The number and configuration (e.g. shape) of the protrusions 7*f* can be varied from the specific exemplary embodiment shown in FIG. 3. Specifically, the number and configuration of the protrusions 7*f* can be set to suit the requirements of a particular application of the connection terminal 7. For example, by varying the configuration of the contact section 7*d* with which the protrusions 7*f* are held in contact with the electrode 2*a* (the contact area), it is possible to vary the contact pressure of each of the points of contact.

Further, in the above-described embodiments, the contact section 7*d* of the connection terminal 7 is shown as substantially rectangular. However other shapes can be used, such as a disc-like, oval, triangular or other shape.

As discussed above, the method of manufacturing the connection terminals 7 can comprise steps of first punching (e.g. stamping) the connection terminals 7 from a flat sheet of metal. Thereafter, the protrusions can be punched out and, in the case of the first embodiment, bent to their proper configurations. Thereafter, the spring portion can be bent to its proper curved configuration. The order of these steps can be varied, or one or more steps can be performed simultaneously.

As described above, in the high-voltage variable resistor of the present invention, at least one protrusion is provided on the contact section of the spring portion of the connection terminal. The possibility of foreign matter adhering to this protrusion is reduced, compared to the above-described conventional terminal. Further, even when foreign matter adheres thereto, the protrusion is held in contact with the electrode so as to slightly dig into (e.g. penetrate) the electrode material, so that defective contact due to the adhesion of the foreign matter is mitigated, thereby making it possible to achieve a stable and reliably contact conduction.

Further, by enlarging the width of the contact section and forming a plurality of protrusions thereon, it is possible to effect contact extending over the length of a line or contact at a point at a plurality of positions over a wide range, so that defective contact due to adhesion of foreign matter is substantially mitigated, thereby making it possible to achieve a stable and reliable contact conduction.

Further, by varying the configuration, number, etc. of the protrusions, it is possible to vary the contact pressure, etc. at each protrusion, thereby making it possible to cope with a variety of connecting conditions.

Although the present invention has been described within the context of a high-voltage variable resistor, those skilled in the art will appreciate that the connection terminal disclosed herein can be used in other electrical components.

Generally, the above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims.

What is claimed is:

1. A high-voltage variable resistor comprising:

an insulating case having at least one open side, which includes a connection terminal accommodating section;

an insulating substrate provided in said insulating case, said substrate having a surface, wherein a resistor and an electrode are formed on said surface;

a rotation shaft which is rotationally supported by said insulating case, wherein said rotation shaft is equipped with a sliding member; and a connection terminal which is provided in said connection terminal accommodating section and which detachably connects said electrode to an input/output lead line;

wherein said connection terminal includes a spring portion bent into a curved form, and said spring portion includes a contact section which has at least one protrusion held in direct press contact with said electrode;

wherein said contact section is wider than other portions of the spring portion.

2. The high-voltage variable resistor according to claim 1, wherein the contact section is arranged in parallel with a plane of said electrode.

3. An electrical component comprising:

a casing having a connection terminal accommodating section disposed therein and an opening for feeding a lead line to said connection terminal accommodating section;

an electrode formed on a substrate, at least a portion of which can be accessed from said connection terminal accommodating section; and a connection terminal disposed within said connection terminal accommodating section for connecting said lead line with said electrode;

wherein said connection terminal includes:

a lead line connection section for forming an electrical contact with said lead line;

a spring portion extending from said lead line connection section, said spring portion terminating in a contact section; and at least one protrusion extending from said contact section for directly contacting said electrode;

wherein said contact section is wider than other portions of the spring portion.

4. The electrical component according to claim 3, wherein said spring portion is curved such that said spring portion can be resiliently compressed upon contact with said electrode.

5. The electrical component according to claim 3, wherein said contact section has a substantially rectangular shape.

6. The electrical component according to claim 3, wherein said at least one protrusion comprises at least one portion of said contact section which is punched from said contact section and deformed to extend outward from a surface of the contact section.

7. The electrical component according to claim 6, wherein said at least one portion comprises a substantially ⊓-shaped punched-out portion which is bent to extend outward from said surface of the contact section.

8. The electrical component according to claim 3, wherein said at least one protrusion comprises at least one portion of said contact section which is punched from said contact section using a die.

9. The electrical component according to claim 8, wherein said at least one portion comprises a substantially cone-shaped member punched out of said contact section.

10. The electrical component according to claim 3, wherein said at least one protrusion comprises a plurality of protrusions.

11. A connection terminal for connecting a lead line with an electrode, comprising:

a lead line connection section for forming an electrical contact with said lead line;

a spring portion extending from said lead line connection section, said spring portion terminating in a contact section; and at least one protrusion extending from said contact section for directly contacting said electrode;

wherein said contact section has a width which is larger than a width of other portions of said spring portion.

12. The connection terminal according to claim 11, wherein said spring portion is curved such that said spring portion can be resiliently compressed upon contact with said electrode.

13. The connection terminal according to claim 11, wherein said contact section has a substantially rectangular shape.

14. The connection terminal according to claim 11, wherein said at least one protrusion comprises at least one portion of said contact section which is punched from said contact section and deformed to extend outward from a surface of said contact section.

15. The connection terminal according to claim 14, wherein said at least one portion comprises a substantially ⊓-shaped punched-out portion which is bent to extend outward from said surface of the contact section.

16. The connection terminal according to claim 11, wherein said at least one protrusion comprises at least one portion of said contact section which is punched from said contact section using a die.

17. The connection terminal according to claim 16, wherein said at least one portion comprises a substantially cone-shaped member punched out of said contact section.

18. The connection terminal according to claim 11, wherein said at least one protrusion comprises a plurality of protrusions.

19. The high-voltage variable resistor of claim 1, wherein said spring portion has a serpentine shape, with the contact section forming a widened head at the distal end of the spring portion, wherein said at least one protrusion comprises a plurality of protrusions dispersed over a top surface of said contact section.

20. The electrical component of claim 3, wherein said spring portion has a serpentine shape, with the contact section forming a widened head at the distal end of the spring portion, wherein said at least one protrusion comprises a plurality of protrusions dispersed over a top surface of said contact section.

21. The connection terminal of claim 11, wherein said spring portion has a serpentine shape, with the contact section forming a widened head at the distal end of the spring portion, wherein said at least one protrusion comprises a plurality of protrusions dispersed over a top surface of said contact section.

* * * * *